US006055699A

United States Patent [19]

Cho

[11] Patent Number: 6,055,699

[45] Date of Patent: May 2, 2000

[54] CLEANING TOOL HEAD WITH MULTI-FILAMENT SEAL

[75] Inventor: Sung K. Cho, Roseville, Minn.

[73] Assignee: CFR Corporation, New Brighton, Minn.

[21] Appl. No.: 08/962,982

[22] Filed: Oct. 16, 1997

Related U.S. Application Data

[60] Provisional application No. 60/028,163, Oct. 16, 1996.

[51] Int. Cl.[7] ..... A47L 7/00

[52] U.S. Cl. ..... 15/321; 15/322

[58] Field of Search ..... 15/314, 321, 322, 15/393

[56] References Cited

U.S. PATENT DOCUMENTS

| | | | |
|---|---|---|---|
| 4,596,061 | 6/1986 | Henning | 1/322 |
| 4,720,889 | 1/1988 | Grave | 15/322 |
| 4,879,784 | 11/1989 | Shero | 15/322 |
| 5,125,126 | 6/1992 | Bonnant | 15/321 |

*Primary Examiner*—David A. Redding

*Attorney, Agent, or Firm*—Larkin, Hoffman, Daly & Lindgren, Ltd.; Frederick W. Niebuhr

[57] ABSTRACT

An adapter plate, removably mounted with respect to the cleaning tool head of a continuous flow recycling cleaning device, supports a fluid flow barrier. The barrier is formed of multiple resilient filaments parallel to one another and packed closely together to resist air passage through the barrier. The filaments are supported in cantilevered fashion, and are individually and locally deformable as the tool head is placed in an operating position near a floor or other surface to be cleaned. The barrier thus conforms to the topography of the surface being cleaned, to achieve a better seal. The barrier is used in combination with a more porous layer, e.g., a carpet tile or a less tightly packed filament arrangement, to channel air from outside of the tool head into an intake compartment while blocking passage to an exhaust compartment inside the tool head.

35 Claims, 4 Drawing Sheets

CLEANING TOOL HEAD WITH MULTI-FILAMENT SEAL

This application claims the benefit of Provisional Application No. 60/028,163 entitled "Cleaning Tool Head With Multi-Filament Seal" filed Oct. 16, 1996.

BACKGROUND OF THE INVENTION

The present invention relates to systems and devices for cleaning floors and other surfaces, and more particularly to cleaning tool heads and cleaning tool head attachments used at the interface of the system and surface.

Cleaning systems that circulate and spray liquids are widely used for cleaning carpets, upholstery, fabric, wall-coverings and hard surfaces such as floors of concrete and ceramic tile. In one such system, known as continuous flow recycling, a liquid cleaning solution is sprayed toward the surface being cleaned. Simultaneously a vacuum source creates a high velocity airstream that draws the atomized liquid toward the surface, along the surface (or into the material in the case of carpeting), then upwardly away from the surface. This extracts soil, debris and other foreign matter along with the cleaning solution. This type of system is disclosed in U.S. Pat. No. 5,555,598 (Grave et al) issued Sep. 17, 1996, which is incorporated herein by reference.

With particular reference to FIGS. 15 and 16 of the '598 patent, a cleaning tool head can have a shell adapted particularly for cleaning hard surfaces such as ceramic tile, concrete and linoleum. Along a lower portion of its forward wall and opposite side walls, the shell is formed of a porous material, e.g. a carpet pad. This facilitates entry of air into an intake compartment inside the shell.

By contrast, the rear wall at least a lower portion adjacent an evacuation compartment inside the shell, is flexible and non-porous. This creates a wiping action like a squeegee against the surface being cleaned, to substantially prevent passage of air directly into the evacuation compartment from outside of the shell. As a result, virtually all air that enters the area beneath the shell enters the intake compartment rather than the exhaust compartment, which facilitates recovery of the cleaning solution and extraction of foreign matter from the surface being cleaned.

Although this approach is effective for cleaning a substantially planar surface, the rear wall even when flexible has limited capability to conform to deviations from surface planarity. Such deviations include, for example, the uniformly spaced apart grooves or depressions where group is applied between adjacent ceramic tiles. Deviations also can include cracks or other unintended surface discontinuities. In either event the flexible, non-porous rear wall of the shell, typically having a linear bottom edge, cannot conform to the surface. The resulting gaps between the rear wall and surface admit air directly into the exhaust compartment, allowing liquid cleaning solution to escape the tool head area and tending to reduce cleaning tool head efficiency.

Therefore, it is an object of the present invention to provide a cleaning system with a cleaning tool head shell that incorporates a barrier, at least along and adjacent the evacuation compartment, that conforms to surface irregularities to more effectively prevent air from entering the shell from certain areas immediately around the shell.

Another object is to provide a cleaning tool head that incorporates a fluid-flow barrier disposed between the tool head and the surface during cleaning, that more closely conforms to surface irregularities and thus provides an improved seal against passage of air and fluids.

A further object is to provide an adapter suitable for removable attachment to cleaning tool heads, to improve the efficiency of such tool heads when used to clean hard surfaces with irregular contours.

Yet another object is to provide a cleaning tool head or a vacuum tool head with an edge region that is substantially non-porous to resist air inflow, while capable of engaging a surface in a conforming manner to afford better control of air entry at the tool head perimeter.

SUMMARY OF THE INVENTION

To achieve these and other objects, there is provided a vacuum cleaning device. The device includes a cleaning tool head including a shell having a shell edge positionable in confronting relation to a selected surface to be cleaned, to orient the shell in an operating position in which the shell and the selected surface form a substantially enclosed chamber. A partition is supported inside the shell to divide the chamber into an intake compartment to accommodate fluid flow into the chamber, and an evacuation compartment to accommodate fluid flow out of the chamber. The partition also defines a gap to accommodate fluid flow from the intake compartment to the evacuation compartment. The shell edge includes a first edge region along the intake compartment, and a second edge region along the evacuation compartment. The shell has a vacuum opening adapted for fluid coupling to a vacuum source operable to draw a vacuum in the evacuation compartment. This draws fluids across the gap from the intake compartment into the evacuation compartment. Multiple barrier elements are mounted with respect to the shell and extend away from the shell. The barrier elements cooperate to form a barrier along the second edge region to resist passage of air therethrough. The barrier elements have respective free ends that cooperate to define a contact-surface contour of the barrier. The barrier elements are positioned for engagement of the free ends with the selected surface. The barrier elements undergo individual and localized resilient deformations after engaging the selected surface as the shell is moved toward the operating position. The localized deformations selectively alter the contact-surface contour toward conformity with a profile of the selected surface.

According to one preferred embodiment, a cleaning tool head or vacuum head is provided with a porous material such as carpeting along a first region of its bottom perimeter. This promotes entry of air into the cleaning tool head from locations immediately outside of the head along the first edge region. Along a second region of the perimeter, a substantially non-porous barrier or seal is provided to resist such entry of air. The first region is aligned with the intake compartment, while the second region is aligned with the evacuation compartment. As a result, virtually all air entering the chamber from immediately around the tool head enters the intake compartment rather than the evacuation compartment.

The seal arrangement along the second region is composed of multiple resilient filaments. The filaments are closely or densely packed, so that collectively they provide a substantially non-porous seal. At the same time, the filaments are elastically deformable and can be flexed independently of their adjacent filaments. Thus, when the seal is adjacent a surface with non-planar features, such as a tile floor with group-containing channels, filaments adjacent the tiles flex to a greater degree then other filaments adjacent the grout areas, while such other filaments extend fully into the channels and complete an effective seal.

A variety of materials can be positioned along the cleaning tool head perimeter to control air and fluid flows. One preferred version of a cleaning tool head incorporates carpeting along its forward and side edges, while an arrangement of tightly packed nylon filaments or bristles extends along the rearward wall. Alternatively, bristles or filaments can be provided about the entire perimeter. In this arrangement, the bristles or filaments forming the rear wall are densely packed, while the bristles along the forward wall and side walls are spaced apart to provide porosity.

While used most effectively in connection with continuous flow recycling cleaning, the multi-filament seal can be used in connection with any cleaning tool head or vacuum head in which it is desired to draw air into the tool head from only a selected portion of the tool head perimeter.

The resilient filaments extend in cantilevered fashion from their point of mounting, supported either directly by the tool head shell, or by an adapter removably coupled to the tool head shell. Typically, they are uniform in length, and define a planar contact-surface contour when in a free state, i.e., when not subject to an external force. Further, the filaments are uniform in size and shape, and thus, uniform in how they respond to elastic deformation. As a result, the barrier's contact surface readily adjusts to conform to a variety of irregularities, whether gradual or abrupt. There is no need to configure the barrier toward conformance with anticipated irregularities, and no need to selectively align the barrier for a closer "fit" with an irregular surface.

Thus, the barrier is adapted to provide an effective seal against air and fluid passage, when used for cleaning substantially rigid surfaces with irregular profiles.

IN THE DRAWINGS

For a further understanding of the above, and other features and advantages, reference is made to the following detailed description and to the drawings, in which.

DETAILED DESCRIPTION OF THE PREFERRED EMBODIMENTS

Figure 1:
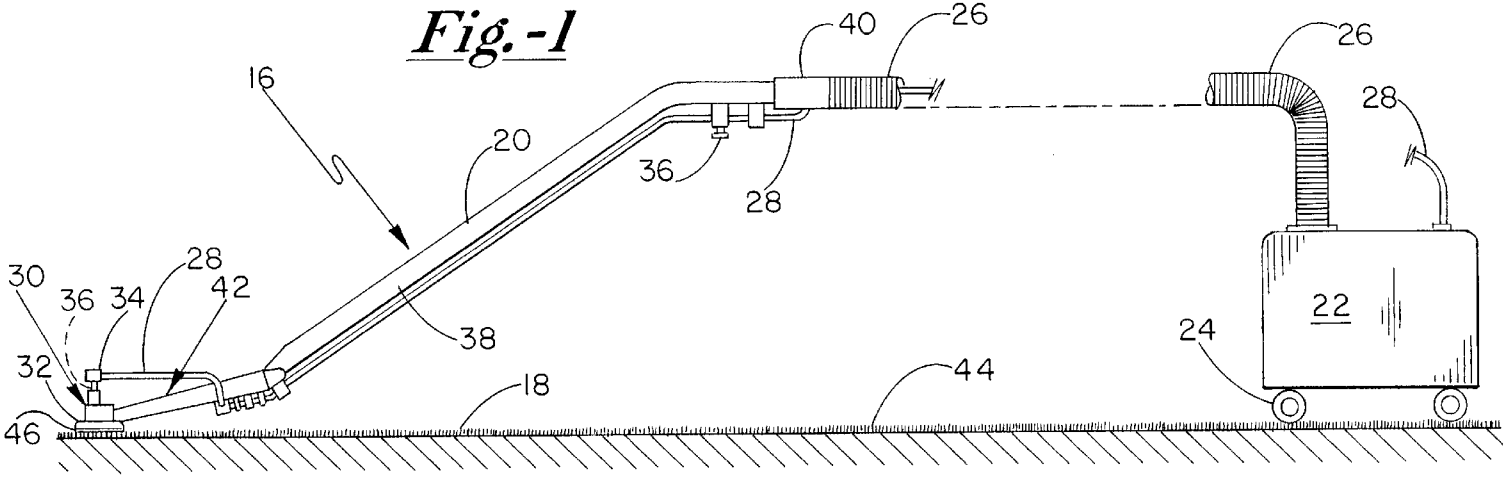
FIG. 1 is a side elevation of a continuous flow recycling surface cleaning system constructed in accordance with the present invention.
Figure 2:
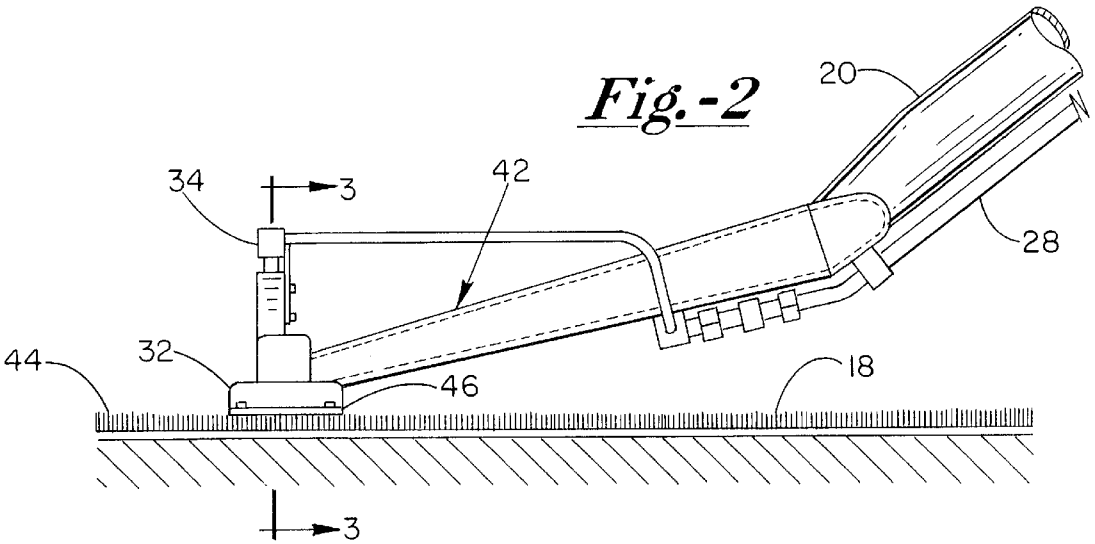
FIG. 2 is an enlarged partial side elevation of the system.

Turning now to the drawings, there is shown in FIGS. 1 and 2 a vacuum operated continuous flow recycling system 16 for cleaning surfaces such as a floor indicated at 18. The system includes a cleaning tool 20 and a canister or tank 22 supported by wheels 24. The cleaning tool is coupled to the canister by a vacuum conduit or hose 26 and by a fluid supply conduit or tubing 28. Conduits 26 and 28 are sufficiently pliable to allow manipulation of the tool independently of the canister, which is particularly useful when cleaning non-horizontal surfaces such as walls, ceilings and upholstered furniture.

The cleaning tool includes a cleaning tool head 30, shown in the operating position in which a shell 32 of the head confronts floor 18. In this position, the shell and the floor cooperate to form an enclosed chamber. Liquid cleaning solution is contained in canister 22 and supplied to the chamber via conduit 28 to manifold 34, and then to a row of nozzles 36 that spray the liquid into the chamber. The nozzles are arranged in a row, each spraying the liquid in a fan-like spray pattern. The nozzles are offset angularly from the row, so that the spray patterns do not interfere with one another, yet provide overlapping coverage. At the same time, a motor (not shown) in canister 22 is operated to draw a vacuum through conduit 26, which is in fluid communication with the chamber through a length of rigid tubing 38 that includes a handle 40, and a somewhat triangular vacuum housing 42 open to tubing 38 and to the chamber.

Figure 3:
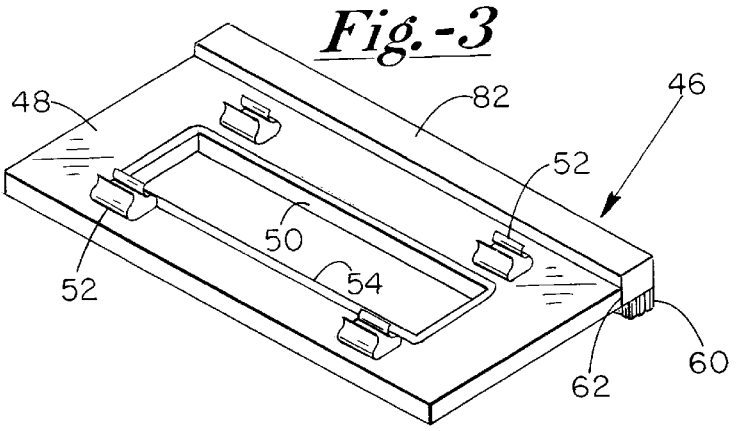
FIG. 3 is a perspective view of an adapter used in the system.
Figure 4:
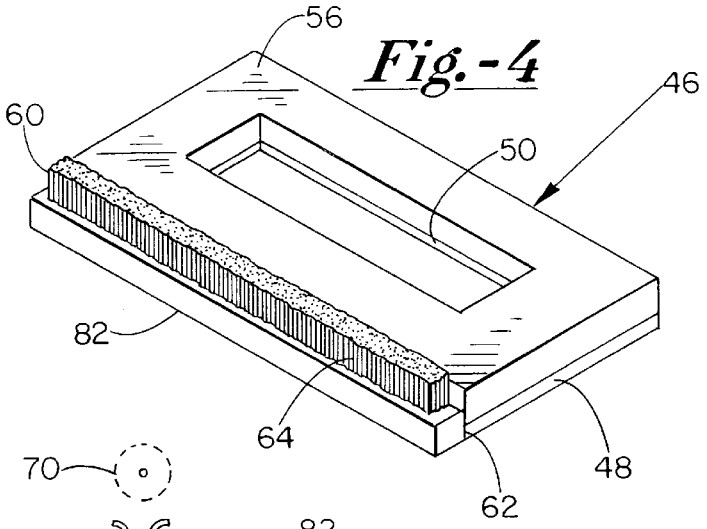
FIG. 4 is a perspective view of the adapter in FIG. 3, showing its bottom surface.
Figure 5:
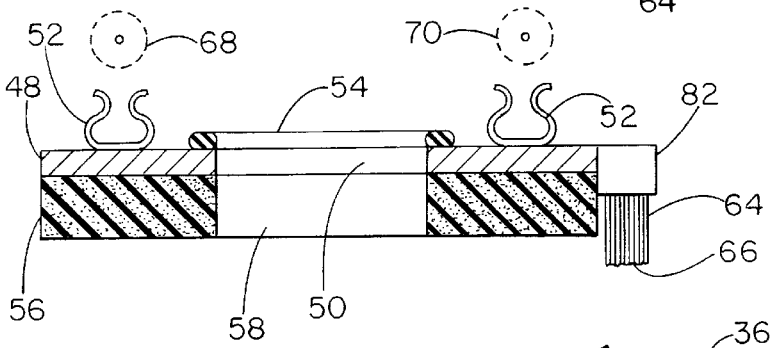
FIG. 5 is a side sectional view of the adapter.

Floor 18 is formed of ceramic tile, and thus has a substantially rigid upper surface 44. Such is the case, also, for floors formed of concrete, linoleum, wood and other materials less compliant than carpeting. For more effective cleaning of these surfaces, it is advantageous to provide a compliant interface between shell 32 and floor 18. To provide such an interface, an adapter 46 is removably coupled to shell 32, and is disposed between the shell and floor 18 in the operating position. FIGS. 3–5 show the adapter in greater detail. The adapter includes a flat, rectangular rigid adapter plate 48, preferably formed of aluminum. An elongate rectangular slot 50 is formed through the adapter plate. Four spring clips 52 are mounted to the adapter plate, in pairs on opposite sides of the slot. A gasket 54 is mounted to plate 48 and surrounds slot 50. When the adapter is mounted to the cleaning tool head, gasket 54 is at least slightly compressed between the tool head and the plate, to prevent air leakage between the adapter and the tool head.

As best seen in FIG. 4, a porous layer 56, preferably a carpet tile or other porous material, is attached to a bottom surface of adapter plate 48. A slot 58 through porous layer 56 corresponds to and is aligned with slot 50 through the plate. A multi-filament seal or barrier 60 is mounted to adapter plate 48, along a rearward edge 62 of the plate. The barrier is composed of multiple individual filaments 64.

As perhaps best seen in FIG. 5, filaments 64 extend downwardly from rearward edge 62 of the adapter plate, beyond porous layer 56. Typically, the filaments are uniform in length, and thus define a planar contact surface 66 for barrier 60. When the system is used to clean floors, contact surface 66 is the bottom surface of the barrier. A pair of rollers, shown in broken lines at 68 and 70, are mounted inside the cleaning tool head shell. Spraying clips 52 elastically deform to capture the rollers, thus to removably maintain adapter 46 against the cleaning tool head.

Figure 6:
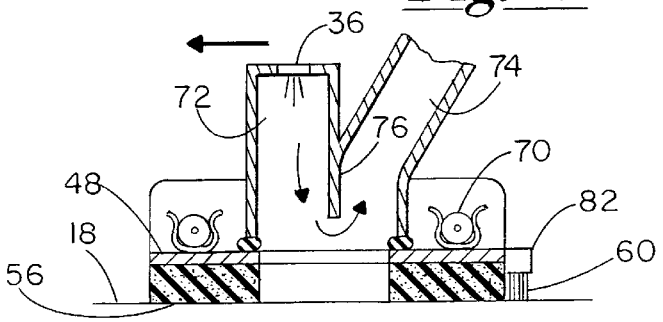
FIG. 6 is a side sectional view of the adapter removably coupled to a cleaning tool head of the system.

In FIG. 6, adapter 46 is shown mounted to cleaning tool head 30. The interior (chamber) of shell 32 includes an intake compartment 72 and an evacuation compartment 74. Liquid cleaning solution is sprayed into the intake compartment by nozzles 36. As the motor in canister 22 draws a vacuum, liquid cleaning solution and matter removed from floor 18 are drawn upwardly into the evacuation compartment, and eventually to the canister. The returned cleaning solution is filtered within the canister before being returned to the cleaning tool head via conduit 28 for reapplication to the floor. Gasket 54 forms a seal between the adapter plate 48 and tool head shell 32. An arrow above the cleaning tool head indicates the normal direction of travel during cleaning, showing that intake compartment 72 is the forward compartment.

As more fully explained in the aforementioned U.S. Pat. No. 5,555,598, a partition 76 has a lower edge parallel to and spaced apart from floor 18, to form a gap that accommodates the flow of air and other fluids from intake compartment 72 to evacuation compartment 74. The partial vacuum in the evacuation compartment draws air and liquid cleaning solution through the gap. Air from immediately outside shell 32 enters intake compartment 72, through slots near the nozzles and from between the shell and floor. Because of barrier 60, air is substantially prevented from entering evacuation chamber 74 from outside of the shell. Thus, nearly all air drawn into the chamber enters the intake compartment rather than the evacuation compartment. Essentially, the vacuum in the chamber is applied solely to draw air and cleaning solution through the gap, for maximum efficiency.

Figure 7:
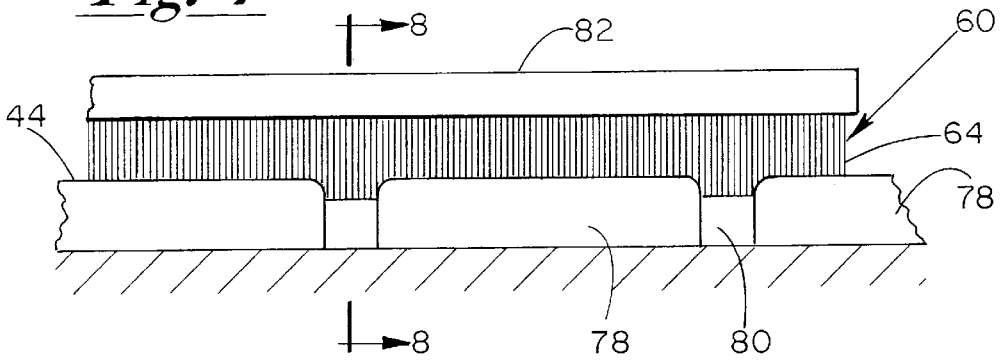
FIG. 7 is a rearward end view of the adapter and cleaning tool head in an operating position against a surface.

In FIG. 7, part of cleaning tool head 30 is shown in rear elevation, supported on floor 18 which consists of ceramic tiles 78 and grouted joints 80 between adjacent tiles. The joints are not as thick as the tiles, and thus form channels or depressions, i.e., discontinuities from surface 44 of floor 18 as determined by the top surfaces of the ceramic tiles. The result is a non-planar profile or topography of the upper surface. In addition to the grouted joints, unintended discontinuities may be present, e.g., cracks in the floor.

In either event, filaments 64 extend into or fill the depressions so that barrier 60 establishes a positive surface engagement with the floor. This substantially prevents passage of air or fluids from outside of shell 32 directly into the evacuation compartment. Because barrier 60 does not have a solid or continuous structure, but rather is made up of the multiple filaments, it can undergo highly localized deformations involving several filaments. As a result, when cleaning tool head 30 is placed in the operating position, the contour of contact surface 66 of the barrier, due to a selective elastic deformation of the filaments, tends to assume the profile of the floor's upper surface 44.

The flexibility of individual filaments 64 and their independence from one another contribute to establishing an effective seal or barrier between the floor and the cleaning tool head. As used here, the term "seal" is not intended to imply a perfect seal that absolutely prevents passage of air or liquid. Rather, barrier 60 is so resistant to the passage of air, that virtually all air passing into the tool head interior enters through porous layer 56 rather than through barrier 60. Given the positioning of the porous layer and the barrier, this results in virtually all such air entering intake compartment 72 rather than evacuation compartment 74. The sealing function of the barrier is considerably enhanced by the dense, closely packed arrangement of filaments 64.

Figure 8:
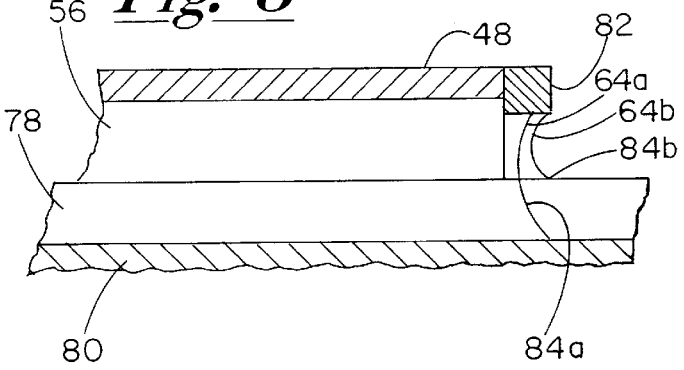
FIG. 8 is an enlarged schematic view illustrating individual filaments of a fluid-flow barrier of the adapter.

The capacity of barrier 60 to conform to the surface of floor 18 is a primary factor in establishing an effective seal, particularly when a floor includes discontinuities such as joints 80. As seen in FIG. 7, some of filaments 64 extend to the tops of tiles 78, and others of filaments 64 extend downwardly beyond the major plane of the surface into joints 80 and against the upper surface of the grout. FIG. 8 illustrates one of the filaments 64*a*, and another of the filaments at 64*b*. Filament 64*b* is aligned with one of ceramic tiles 78, while filament 64*a* is aligned with grouted joint 80 and extends into the joint to the grout. These filaments are the same length, and when the tool head and adapter are removed from the floor, filaments 64*a* and 64*b* extend the same distance from adapter plate 48, more particularly from an elongate support 82 that holds the upper ends of the filaments. With adapter plate 48 in the operating position as shown, free ends 84*a* and 84*b* of the filaments, i.e., the ends remote from the tool head shell, are in contact with floor 18, which causes each filament to bend. Because joints 80 are recessed relative to tiles 78, the bend in filament 64*a* is only slight, while the bend in filament 64*b* is more pronounced. Both deformations are elastic. As soon as the cleaning tool head is removed from the floor, the filaments 64*a* and 64*b*, along with the remaining filaments, resiliently return to their free-state shape, which is linear. Thus, filaments 64 are elastically deformable individually and substantially independently of one another. As a result, barrier 60 is capable of highly localized deformations to accommodate or conform to abrupt surface continuities in floor 18.

Figure 9:
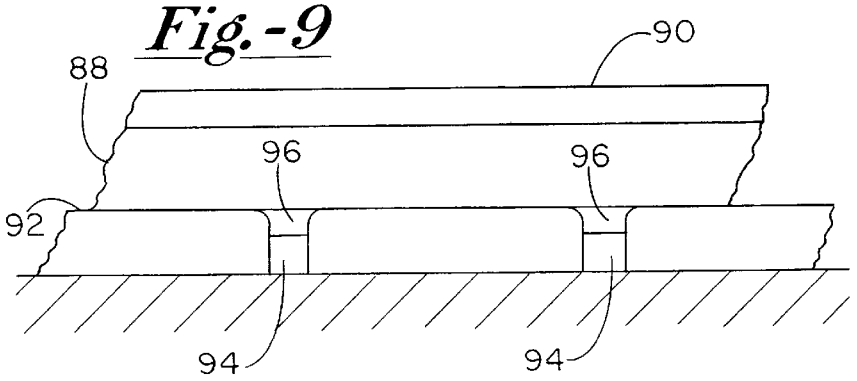
FIG. 9 is a view similar to that in FIG. 7, but showing a continuous flexible wall (prior art) instead of the multi-filament barrier in FIG. 7.

By contrast, FIG. 9 illustrates a continuous, flexible wall portion or strip 88 formed of a flexible, non-porous material such as rubber or another elastomer, occupying space between a cleaning tool head 90 and a floor 92. Despite being flexible, strip 88 lacks the capacity to conform to the upper surface of floor 92, specifically at grouted joints 94. Consequently, a series of gaps 96 are formed between the flexible strip and the floor, one at each of the grouted joints. The rubber strip cannot conform to the surface, although its bottom edge may dip slightly into the gaps. As a result, water or cleaning solution tend to remain on the floor within the joints, and may escape from the cleaning tool head area.

With further reference to FIGS. 7 and 8, several factors contribute to the effectiveness of barrier 60. One is the structure of the individual filaments. More particularly, the filaments are highly resilient, whereupon each filament individually is bendable to reduce its effective length by the amount required by the spacing between adapter plate 48 and floor 18 at the specific location. Each filament readily bends the required amount, and resiliently recovers to its normal linear configuration upon removal of the adapter from contact with the floor or other surface.

Another factor is that the filaments, while connected with respect to plate 48 at their upper ends, otherwise are mounted independently of one another. Independent filaments are free to bend an amount corresponding to their adjacent portions of the floor or other surface. Consequently, barrier 60 readily conforms to the surface, although discontinuities may be severe or abrupt.

Yet another factor is the dense or closely packed arrangement of the filaments. This enables the filaments, collectively, to provide an effectively non-porous barrier to the passage of air. This barrier or seal need not be absolute in order to insure that virtually all air entering the tool head at locations between the tool head and floor, enters through a porous layer rather than through the barrier.

In general, the filaments of barrier 60 provide a seal sufficient for operating at high pressures (up to 400 psi) for handling flows of liquid cleaning solution up to 1.2 gallons per minute, and accommodating vacuum pressures of 130 inches ($H_2O$) or more in evacuation compartment 74.

One particularly preferred material for forming filaments 64 is 6.0 nylon, which imparts the desired combination of flexibility, good elastic memory, durability and strength.

Nylon (6.0) has a modulus of elasticity in the range of 25–50 grams per denier. Other suitable materials include polypropylene and polyester. Individual filaments or bristles can have diameters in the range of about 0.003–0.015 inches (0.076–0.38 mm), and exposed or unsupported lengths in the range of about 0.35–0.75 inches (8.9–19 mm). Individual filaments preferably are rounded or circular in section, but need not be.

In one exemplary arrangement found effective, 6.0 nylon filaments with diameters of 0.006 inches have exposed or unsupported lengths of 0.45 inches. The filaments are arranged in approximately eight adjacent and staggered rows of filaments. The density within each row is about 163 filaments per inch, for a total of about 1,300 filaments per inch, lengthwise along the barrier. In each row, the filaments account for about 0.978 inches of each inch along the row, with space between filaments accounting for the remaining 0.022 inches, yielding a linear density (in terms of length occupied by filaments compared to that length plus that occupied by spaces between filaments) of about 98%. Different filament diameters, filament lengths and densities are appropriate in different situations. For example, more severe surface discontinuities call for longer, more flexible or thinner filaments. A tighter, more effective seal is achieved by a more closely packed arrangement of filaments or a wider barrier.

Figure 10:
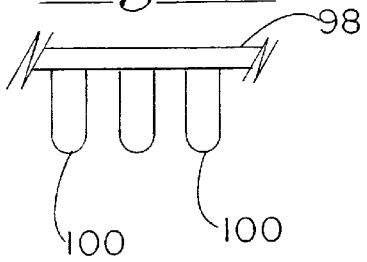
FIGS. 10 and 11 illustrate alternative embodiment barrier elements or filaments.
Figure 11:
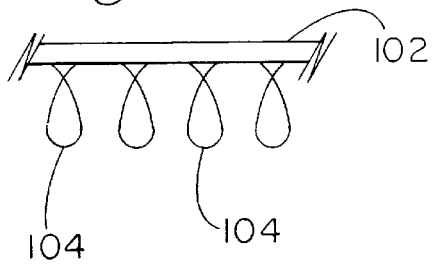

While the preferred filament configuration is linear, FIGS. 10 and 11 illustrate alternative filament shapes. In FIG. 10, a support 98 carries multiple filaments 100, each bent into a shape that resembles the letter "U." In FIG. 11, an elongate support 102 carries multiple filaments 104, each of which is formed into an elongate, substantially closed loop.

Figure 12:
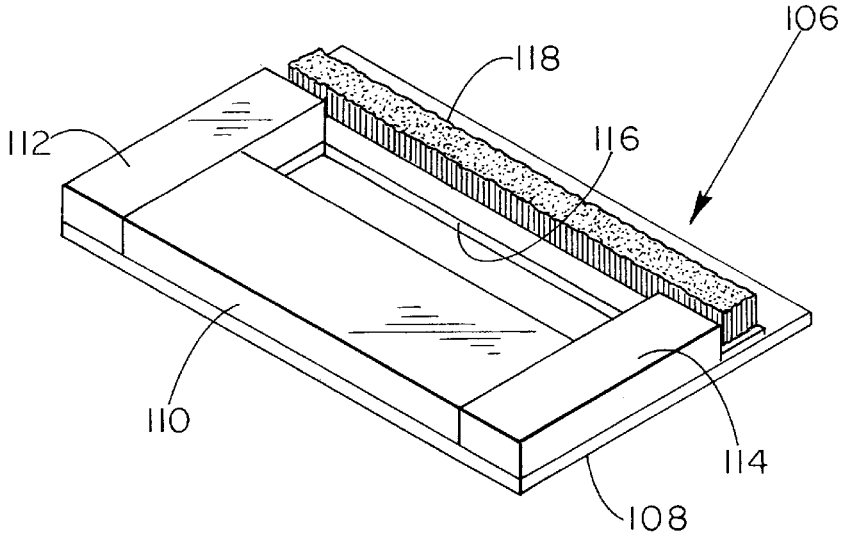
FIG. 12 illustrates an alternative embodiment adapter.

FIG. 12 illustrates a preferred alternative embodiment adapter 106 including an aluminum adapter plate 108 similar to plate 48, a carpet pad 110 to provide a porous layer across a forward wall of the plate, and sponge rubber seals 112 and 114 along opposite side walls of the plate. An elongate rectangular slot 116 is formed through the plate. A multi-filament barrier 118 is mounted to plate 108 at a location directly behind slot 116, rather than along the rearward edge of the plate. Sponge rubber seals 112 and 114 provide a tighter air seal along both sides of the cleaning tool head, thus to channel air flow into the intake compartment from in front of the cleaning tool head. Positioning the multiple filament barrier immediately adjacent slot 116 improves drying time as compared to an arrangement in which the barrier is along a rearward edge of the plate.

Figure 13:
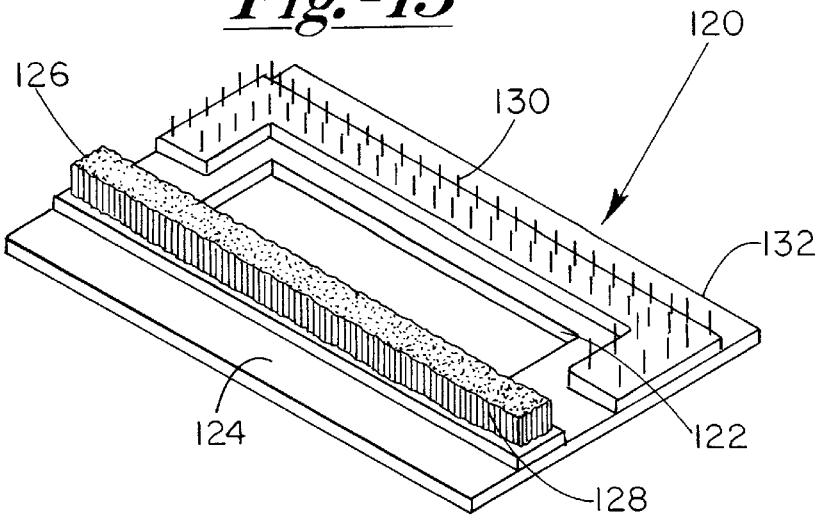
FIG. 13 illustrates another alternative embodiment adapter.

FIG. 13 illustrates another alternative adapter 120 in which a rectangular slot 122 is formed through an aluminum adapter plate 124 as in the previous embodiments. A multi-filament barrier 126, formed of densely packed filaments 128 as in the previous embodiments, is mounted along the plate immediately behind slot 122. Multiple spacer filaments 130 also are mounted to the adapter plate, along its front and sides, to form a more loosely packed filament arrangement or porous layer 132. Layer 132, due to a greater spacing between adjacent filaments 130 as compared to the spacing between filaments 128 of the barrier, permits the passage of air into the cleaning tool head, much like carpeting or other porous material in the previous embodiments. Filaments 130 provide the primary support and orientation for the cleaning tool head. Accordingly, they have considerably more stiffness than filaments 128. The enhanced stiffness can result from use of a different filament material, larger filament diameter, shorter filament unsupported length, or a combination of these factors.

In the embodiments of the invention presented, the multi-filament barrier is supported on an adapter plate, which in turn is removably supported on the shell of the cleaning tool head. This arrangement is preferred, primarily due to its versatility in that the cleaning tool head can be used for a variety of other applications where an alternative adapter, or no adapter, may be employed. This notwithstanding, it is to be understood that the invention could be practiced with a custom tool head shell that directly supports the filaments that form the fluid-flow barrier.

Thus, in accordance with the present invention, multiple filaments form a fluid flow barrier between a cleaning tool head and floor whenever the head is in the operating position. The filaments are sufficiently closely packed to resist passage of air through the barrier, yet are individually elastically bendable to allow localized deformations in the barrier conforming to non-planar features of the surface being cleaned, for a better seal.

What is claimed is:

1. A vacuum cleaning device, including:

a cleaning tool head including a shell having a shell edge positionable in confronting relation to a selected surface to be cleaned, to orient the shell in an operating position in which the shell and the selected surface form a substantially enclosed chamber;

a partition supported inside of the shell to divide the chamber into an intake compartment to accommodate fluid flow into the chamber and an evacuation compartment to accommodate fluid flow out of the chamber, and further to define a gap to accommodate a fluid flow from the intake compartment to the evacuation compartment;

wherein the shell edge includes a first edge region along the intake compartment and a second edge region along the evacuation compartment;

vacuum opening to the chamber adapted for fluid coupling to a vacuum source operable to draw a vacuum in the evacuation compartment and thereby draw fluids across the gap from the intake compartment into the evacuation compartment; a porous layer along the first edge region adapted to allow passage of air therethrough into the intake compartment; and multiple barrier elements mounted with respect to the shell, extended away from the shell, and cooperating to form a barrier along the second edge region to resist passage of air therethrough, with respective free ends of the barrier elements cooperating to define a contact-surface contour of the barrier;

wherein the barrier elements are positioned for an engagement of their respective free ends with the selected surface, and are adapted to undergo individual and localized resilient deformations after said engagement as the shell is moved toward the operating position, to alter the contact-surface contour toward conformity with a profile of the selected surface.

2. The device of claim 1 wherein:

said barrier elements comprise elongate resilient filaments.

3. The device of claim 2 wherein:

the filaments have diameters in the range of about 3–15 mils (0.076–0.38 mm.), and unsupported lengths in the range of about 0.35–0.75 inches (8.9–19 mm.).

4. The device of claim 2 wherein:

the filaments are parallel to one another.

5. The device of claim 4 wherein:

the filaments are arranged in side-by-side rows, with the filaments in each row accounting for about 98% of the row's length.

6. The device of claim 1 wherein:

the first and second edge regions are substantially planar.

7. The device of claim 6 wherein:

the shell edge is rectangular, including an elongate forward edge portion, an elongate rear edge portion, and two opposite side edge portions, and the second edge region is comprised of the rear edge portion.

8. The device of claim 7 wherein:

the first edge region comprises the forward edge portion, the porous layer is mounted to the shell along the forward edge portion, and opposed substantially non-porous elastomeric layers are mounted to the shell along the side edge portions.

9. The device of claim 1 wherein:

the barrier is releasably mounted to the shell.

10. The device of claim 9 further including:

a substantially rigid adapter releasably mounted to the shell and defining an elongate slot substantially centered in the adapter, wherein the barrier is secured to the adapter along an edge of the slot.

11. The device of claim 1 wherein:

the partition has a linear edge disposed near the selected surface when the shell is in the operating position, thereby to locate said gap between the linear edge and the selected surface.

12. The device of claim 1 wherein:

said porous layer is comprised of multiple filaments mounted with respect to the shell, extending away from the shell, and spaced apart from one another to allow a fluid flow between filaments.

13. The device of claim 1 wherein:

the porous layer determines the spacing between the shell and selected surface in the operating position.

14. A continuous flow recycling cleaning system, including:

a reservoir containing a liquid cleaning solution;

a cleaning tool head including an open shell positionable in confronting relation to a selected surface to be cleaned, in an operating position in which the shell and the selected surface cooperate to form a substantially enclosed chamber;

a partition supported inside the shell to divide the chamber into an intake compartment for receiving air and other fluids into the chamber, and an evacuation compartment for accommodating fluid flow out of the chamber, and further defining a gap to accommodate fluid flow from the intake compartment to the evacuation compartment;

a supply conduit fluid-coupled to the reservoir and to the cleaning tool head, for supplying the liquid cleaning solution from the reservoir to the intake compartment;

a return conduit fluid coupled to the shell and to the reservoir, for conveying the cleaning solution and air from the evacuation compartment to the reservoir;

a vacuum source for drawing the cleaning solution and air toward the reservoir through the return conduit;

a porous layer mounted with respect to the shell, disposed between the shell and the selected surface when the shell is in the operating position, and adapted to permit the flow of air and other fluids directly into the intake compartment from outside of the shell; and multiple barrier elements mounted with respect to the shell and having remote ends spaced apart from the shell, said barrier elements cooperating to form a fluid-flow barrier, with the remote ends of the barrier elements cooperating to define a contact-surface contour of the barrier;

wherein the barrier, when the shell is in the operating position, is disposed between the shell and the selected surface with the remote ends of the barrier elements in contact with the selected surface; and wherein the barrier elements further are adapted to undergo individual and localized resilient deformations to accommodate placement of the shell in the operating position, to selectively alter the contact-surface contour toward conformity with a profile of the selected surface, whereby the barrier substantially prevents passage of air and other fluids directly into the evacuation compartment from outside of the shell.

15. The system of claim 14 wherein:

the barrier elements comprise resilient filaments.

16. The system of claim 15 wherein:

the resilient filaments extend parallel to one another and are packed sufficiently closely to one another to substantially prevent flow of air between adjacent filaments.

17. The system of claim 16 wherein:

the spacing between the shell and selected surface in the operating position is determined substantially by the porous layer.

18. The system of claim 17 wherein:

the cleaning tool head further incorporates a substantially fluid impermeable polymeric layer between the porous layer and the barrier.

19. The system of claim 17 wherein:

the porous layer comprises multiple filaments in a loosely-packed arrangement that permits the passage of air between adjacent filaments.

20. The system of claim 15 further including:

an application component for spraying the cleaning solution into the intake compartment.

21. The system of claim 20 wherein:

the application component includes the plurality of nozzles generating respective fan-like spray patterns, oriented at a predetermined angle to ensure that the spray patterns provide overlapping coverage without interfering with one another.

22. The system of claim 15 wherein:

the barrier is removably mounted to the shell through an adapter.

23. A vacuum cleaning device including:

a cleaning tool head including a shell having a shell edge positionable in confronting relation to a selected surface to be cleaned, to orient the shell in an operating position in which the shell and the selected surface form a substantially enclosed chamber;

a partition supported inside the shell to divide the chamber into an intake compartment to accommodate fluid flow into the chamber and an evacuation compartment to accommodate fluid flow out of the chamber, and further to define a gap to accommodate fluid flow from the intake compartment to the evacuation compartment, said partition having a linear edge disposed near the selected surface when the shell is in the operating position, thereby to locate the gap between the linear edge and the selected surface;

wherein the shell edge includes a first edge region along the intake compartment and a second edge region along the evacuation compartment;

a vacuum opening to the chamber adapted for fluid coupling to a vacuum source operable to draw a vacuum in the evacuation compartment and thereby draw fluids across the gap from the intake compartment into the evacuation compartment; and multiple barrier elements mounted with respect to the shell and having remote ends spaced apart from the shell, said barrier elements cooperating to form a fluid-flow barrier along the second edge region, with the remote ends of the barrier elements cooperating to define a contact-surface contour of the barrier;

wherein the barrier elements are positioned for an engagement of their respective free ends with the selected surface, and are adapted to undergo individual and localized resilient deformations after said engagement as the shell is moved toward the operating position, to alter the contact-surface contour toward conformity with a profile of the selected surface.

24. The device of claim 23 wherein:

said barrier elements comprise elongate resilient filaments.

25. The device of claim 23 wherein:

the shell edge is rectangular, including an elongate forward edge portion, an elongate rear edge portion, and two opposite side edge portions, and the second edge region is comprised of the rear edge portion.

26. The device of claim 23 wherein:

the barrier is releasably mounted to the shell.

27. The device of claim 23 further including:

a porous layer along the first edge region adapted to allow passage of air therethrough into the intake compartment.

28. A continuous flow recycling cleaning system, including:

a reservoir containing a liquid cleaning solution;

a cleaning tool head including an open shell positionable in confronting relation to a selected surface to be cleaned, in an operating position in which the shell and the selected surface cooperate to form a substantially enclosed chamber;

a partition supported inside the shell to divide the chamber into an intake compartment for receiving air and other fluids into the chamber, and an evacuation compartment for accommodating fluid flow out of the chamber, and further defining a gap to accommodate fluid flow from the intake compartment to the evacuation compartment;

a supply conduit fluid-coupled to the reservoir and to the cleaning tool head, for supplying the liquid cleaning solution from the reservoir to the intake compartment;

an exhaust conduit fluid coupled to the shell, for conveying the cleaning solution and air from the evacuation compartment;

a vacuum source for drawing the cleaning solution and air through the exhaust conduit; and a barrier mounted removeably to the shell and comprising multiple barrier elements having remote ends spaced apart from the shell and cooperating to define a contact-surface contour of the barrier;

wherein the barrier, when the shell is in the operating position, is disposed between the shell and the selected surface with the remote ends of the barrier elements in contact with the selected surface; and wherein the barrier elements further are adapted to undergo individual and localized resilient deformations to accommodate placement of the shell in the operating position, to selectively alter the contact-surface contour toward conformity with a profile of the selected surface, whereby the barrier substantially prevents passage of air and other fluids directly into the evacuation compartment from outside of the shell.

29. The system of claim 28 wherein:

the barrier elements comprise resilient filaments.

30. The system of claim 29 wherein:

the resilient filaments extend parallel to one another and are packed sufficiently closely to one another to substantially prevent flow of air between adjacent elements.

31. The system of claim 28 further including:

a porous layer mounted with respect to the shell and disposed between the shell and the selected surface when the shell is in the operating position, and adapted to permit the flow of air and other fluids directly into the intake compartment from outside the shell.

32. A continuous flow recycling cleaning system, including:

a reservoir containing a liquid cleaning solution;

a cleaning tool head including an open shell positionable in confronting relation to a selected surface to be cleaned, in an operating position in which the shell and the selected surface cooperate to form a substantially enclosed chamber;

a partition supported inside the shell to divide the chamber into an intake compartment for receiving air and other fluids into the chamber, and an evacuation compartment for accommodating fluid flow out of the chamber, and further defining a gap to accommodate fluid flow from the intake compartment to the evacuation compartment, said partition having a linear edge disposed near the selected surface when the shell is in the operating position, thereby to locate said gap between the linear edge and the selected surface;

a supply conduit fluid-coupled to the reservoir and to the cleaning tool head, for supplying the liquid cleaning solution from the reservoir to the intake compartment;

an exhaust conduit fluid coupled to the shell, for conveying the cleaning solution and air from the evacuation compartment;

a vacuum source for drawing the cleaning solution and air through the exhaust conduit; and multiple barrier elements mounted with respect to the shell and having remote ends spaced apart from the shell, said barrier elements cooperating to form a fluid-flow barrier, with the remote ends of the barrier elements cooperating to define a contact-surface contour of the barrier;

wherein the barrier, when the shell is in the operating position, is disposed between the shell and the selected surface with the remote ends of the barrier elements in contact with the selected surface; and wherein the barrier elements further are adapted to undergo individual and localized resilient deformations to accommodate placement of the shell in the operating position, to selectively alter the contact-surface contour toward conformity with a profile of the selected surface, whereby the barrier substantially prevents passage of air and other fluids directly into the evacuation compartment from outside of the shell.

33. The system of claim 32 wherein:

the barrier elements comprise resilient filaments.

34. The system of claim 33 wherein:

the resilient filaments extend parallel to one another and are packed sufficiently closely to one another to substantially prevent flow of air between adjacent filaments.

35. The system of claim 32 further including:

a porous layer mounted with respect to the shell, disposed between the shell and the selected surface when the shell is in the operating position, and adapted to permit the flow of air and other fluids directly into the intake compartment from outside of the shell.

* * * * *